US008506035B2

(12) United States Patent
Roof et al.

(10) Patent No.: US 8,506,035 B2
(45) Date of Patent: Aug. 13, 2013

(54) APPARATUS AND METHOD FOR APPLYING RELEASE FLUID TO A LEVELER IN A PRINTING APPARATUS

(75) Inventors: Bryan J. Roof, Newark, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 157 days.

(21) Appl. No.: 13/193,045

(22) Filed: Jul. 28, 2011

(65) Prior Publication Data

US 2013/0027454 A1 Jan. 31, 2013

(51) Int. Cl.

| | |
|---|---|
| ***B41J 29/38*** | (2006.01) |
| ***B41J 29/393*** | (2006.01) |
| ***B41J 2/165*** | (2006.01) |

(52) U.S. Cl.

USPC ..... 347/14; 347/19; 347/22

(58) Field of Classification Search

None

See application file for complete search history.

(56) References Cited

U.S. PATENT DOCUMENTS

| | | | | |
|---|---|---|---|---|
| 2007/0070108 | A1* | 3/2007 | Mantell et al. | 347/19 |
| 2007/0182800 | A1* | 8/2007 | Fioravanti et al. | 347/103 |
| 2010/0073410 | A1* | 3/2010 | Yui et al. | 347/6 |
| 2010/0177151 | A1* | 7/2010 | Thompson et al. | 347/102 |

* cited by examiner

*Primary Examiner* — Stephen Meier

*Assistant Examiner* — Alexander C Witkowski

(74) *Attorney, Agent, or Firm* — Ronald E. Prass, Jr.; Prass LLP

(57) ABSTRACT

An apparatus and method apply release fluid to a leveler in a printing apparatus. The apparatus can include a substrate path, at least one release fluid spray nozzle, and a marking material leveling system having a marking material leveler. The method can include transporting a substrate with marking material along the substrate path. The method can include pulse spraying release fluid to the marking material leveling system using the at least one release fluid spray nozzle. The method can include leveling marking material on the substrate using the marking material leveler with release fluid. The method can include determining an adjusted amount of release fluid to spray to the marking material leveling system. The method can include pulse spraying the adjusted amount of release fluid to the marking material leveling system using the at least one release fluid spray nozzle.

20 Claims, 5 Drawing Sheets

APPARATUS AND METHOD FOR APPLYING RELEASE FLUID TO A LEVELER IN A PRINTING APPARATUS

RELATED APPLICATIONS

This application is related to U.S. patent application Ser. No. 13/193,163, entitled "Apparatus and Method for Applying Release Fluid to a Leveler in a Printing Apparatus,", by Anthony S. Condello, filed Jul. 28, 2011, the same filing date as the present application, which is commonly assigned to the assignee of the present application, and which is incorporated herein by reference in its entirety.

BACKGROUND

Disclosed herein is an apparatus and method that applies release fluid to a leveler in a printing apparatus.

Presently, wax based phase change inks, otherwise known as solid inks, and radiation curable gel inks, such as ultraviolet inks, can be jetted directly onto a media web or cut sheet media in printing devices using ink jet direct marking technology. For solid inks, after ink has been deposited on a media sheet, the ink must be leveled by a leveler. The leveler includes a potentially heated leveler roll which holds a sacrificial release fluid that in turn contacts the ink on the media. A backing pressure roll supplies nip pressure in order to spread the ink. In order to prevent ink on the media sheets from offsetting to the leveler roll, the leveler roll must maintain a uniform layer of a sacrificial release fluid, usually a silicone oil, to avoid intimate contact between the ink and bare leveling surface. In the case of radiation curable inks, a sacrificial release fluid is also used, but unlike the case of solid ink where a more viscous oil is used, radiation curable inks have been shown to perform well with water based fluids containing small amounts of polymers and/or surfactants along with other various additives. The resulting viscosity of the release fluids used with radiation curable inks is substantially less than the fluids typically used with solid ink and are in fact close to the viscosity of water.

Contact leveling may be an integrated part of an ultraviolet gel ink printing system. As discussed, the contact leveler is essentially a pair of rollers, much like a fuser roll/pressure roll configuration used in xerographic processes, which is required to spread the ink prior to final radiation cure. Much like a fuser, the leveling roll needs to have surface characteristics that inhibit the ink from adhering to, and remaining at least partially adhered to the leveling roll as the media leaves the nip. This process of having cohesive failure within the ink and leaving potions of the image behind and adhered to the leveling roll is typically referred to as offsetting.

Since the radiation curable ink typically is using water based released fluids, an analogy can be made to fountain solutions that are used in lithographic printing processes In lithographic printing, a device is used to deliver a controlled and metered amount of fluid from a sump, through the roll train where the film is continually split and eventually to the imaging plate surface in a uniform layer. This roll train, commonly referred to as a dampening system, is both expensive and requires a high degree of skill to setup and maintain. Furthermore, it is also difficult to adjust fluid delivery rates while running the damping system. This is an issue in radiation curable inks, because there is a need to account for desired changes due to media carry-out rates, contamination of rolls, different inks, different ink amounts related to digital imaging, etc. Unlike the lithographic process, radiation curable leveling requires a uniform layer across the entire roll to avoid intimate contact between the ink and the entire leveling surface. Digital printing by nature has shorter run lengths and therefore setup times become more relevant. Furthermore, newspaper machines use a roll train that is sprayed with a water solution. However, these machines continuously apply the solution to the roll train, which would apply excessive fluid for other applications.

Additionally, in cut sheet operations some damping systems or related release agent management systems start out with a large amount of film on the rolls, which can lead to the first few sheets having too much release agent resulting in inconsistent output across the media run. Again, since digital print runs are short, this becomes a quality issue as well.

Thus, there is a need for an improved apparatus and method that applies release fluid to a leveler in a printing apparatus.

SUMMARY

An apparatus and method that applies release fluid to a leveler in a printing apparatus is disclosed. The apparatus can include a substrate path, at least one release fluid spray nozzle, and a marking material leveling system having a marking material leveler. The method can include transporting a substrate with marking material along the substrate path. The method can include pulse spraying release fluid to the marking material leveling system using the at least one release fluid spray nozzle. The method can include leveling marking material on the substrate using the marking material leveler with release fluid. The method can include determining an adjusted amount of release fluid to spray to the marking material leveling system. The method can include pulse spraying the adjusted amount of release fluid to the marking material leveling system using the at least one release fluid spray nozzle.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and do not limit its scope, the disclosure will be described and explained with additional specificity and detail through the use of the drawings in which.

DETAILED DESCRIPTION

The embodiments include a method of applying release fluid to a leveler in an apparatus having a substrate path, at least one release fluid spray nozzle, and a marking material leveling system having a marking material leveler. The method can include transporting a substrate with marking material along the substrate path. The method can include pulse spraying release fluid to the marking material leveling system using the at least one release fluid spray nozzle. The method can include leveling marking material on the substrate using the marking material leveler with release fluid. The method can include determining an adjusted amount of release fluid to spray to the marking material leveling system. The method can include pulse spraying the adjusted amount of release fluid to the marking material leveling system using the at least one release fluid spray nozzle.

The embodiments further include an apparatus for applying release fluid to a leveler in a printing apparatus. The apparatus can include a substrate path that transports a substrate with marking material. The apparatus can include a marking material leveling system having a marking material leveler. The apparatus can include at least one release fluid spray nozzle that pulse sprays release fluid to the marking material leveling system, where the marking material leveler with the release fluid levels marking material on the substrate. The apparatus can include a controller that determines an adjusted amount of release fluid to spray to the marking material leveling system. The at least one release fluid spray nozzle can pulse spray the adjusted amount of release fluid to the marking material leveling system.

The embodiments further include a method of applying release fluid to a leveler in an apparatus including a substrate path, at least one release fluid spray nozzle, and a marking material leveling system having a marking material leveler. The method can include transporting a substrate with marking material along the substrate path. The method can include pulse width modulation spraying release fluid to the marking material leveling system using the at least one release fluid spray nozzle. The method can include leveling marking material on the substrate using the marking material leveler with release fluid. The method can include determining an adjusted amount of release fluid to spray to the marking material leveling system. The method can include pulse width modulation spraying the adjusted amount of release fluid to the marking material leveling system using the at least one release fluid spray nozzle.

Figure 1:
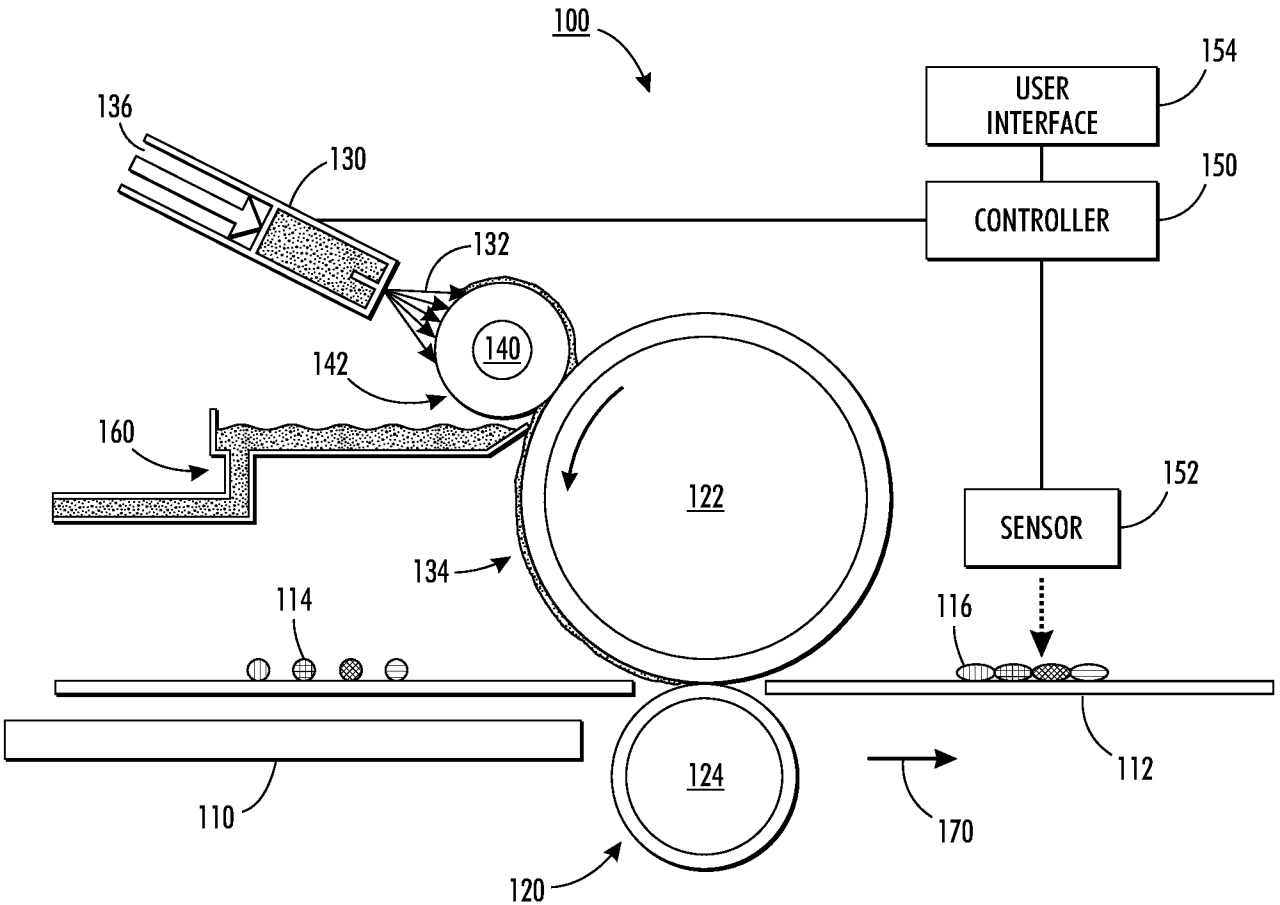
FIG. 1 is an example illustration of an apparatus that can be used with an radiation curable ink printing apparatus according to one possible embodiment.

FIG. 1 is an example illustration of an apparatus 100 that can be used with a radiation curable ink printing apparatus, such as an ultraviolet curable ink printing apparatus, according to one embodiment. The apparatus 100 may also be part of a printer, a multifunction media device, or any other device that generates an image on media. The apparatus 100 can include a substrate path 110 that transports a substrate 112 with marking material 114. The marking material 114 can be radiation curable ink, such as ultraviolet curable ink, or other marking material. The apparatus 100 can include a marking material leveling system 120 having a marking material leveler 122. The apparatus 100 can include at least one release fluid spray nozzle 130 that pulse sprays release fluid 132 to the marking material leveling system 120. "Pulsing," such as pulse spraying, release fluid comprises spraying the release fluid on and off at regular, periodic, and/or designated intervals. Prior printing apparatus release fluid application devices could not pulse spray release fluid because they did not use spray nozzles and did not use a water based release fluid that could be used with spray nozzles. Water based fluid was only applied using a roll train in lithographic printing. The marking material leveler 122 with the release fluid can level marking material 114 on the substrate 112. The apparatus 100 can include a controller 150 that determines an adjusted amount of release fluid 132 to spray to the marking material leveling system 120. The at least one release fluid spray nozzle 130 can pulse spray the adjusted amount of release fluid 132 to the marking material leveling system 120.

The marking material leveling system 120 can include a donor roll 140. The at least one release fluid spray nozzle 130 can pulse spray release fluid 132 onto the donor roll 140. The donor roll 140 can transfer the release fluid 132 from the at least one release fluid spray nozzle 130 to the marking material leveler 122. The donor roll 140 can include a porous coating 142 that receives the release fluid 132 from the spray nozzle 130 and applies the release fluid 132 to the marking material leveler 122. For example, the porous coating 142 can be a fabric, a capillary material, or any other porous coating.

The apparatus 100 can include a user interface 154. The user interface 154 can receive a user input of a media type of the substrate 112. The user interface 154 can include a keypad, buttons, a touch pad, a joystick, an additional display, a touch screen display, or any other device useful for providing an interface between a user and an electronic device. The apparatus 100 can also include a fountain solution return 160 that can filter, reclaim, and/or discard release fluid 132.

The controller 150 can determine an adjusted amount of release fluid 132 to spray to the marking material leveling system 120 based on the media type of the substrate 112. The apparatus 100 can also include a moisture sensor 152. The moisture sensor 152 can measure moisture on the substrate 112 after the substrate 112 leaves the marking material leveler 120. The controller 150 can determine an adjusted amount of release fluid 132 to spray to the marking material leveling system 120 based on the measured moisture on the substrate 112. The sensor 152 can be a moisture meter or any other sensor that can sense moisture. The amount of release fluid can be adjusted by adjusting pulse width modulation of release fluid from the spray nozzle 130, adjusting frequency of spray of release fluid from the spray nozzle 130, adjusting pressure of release fluid from the spray nozzle 130, and/or other methods of adjusting an amount of pulse sprayed release fluid.

The controller 150 can determine an adjusted amount of release fluid to spray to the marking material leveling system 120 based on throughput speed 160 of the substrate 112 through the marking material leveling system 120. The controller 150 can determine the adjusted amount of release fluid to provide a uniform release fluid layer on a surface 134 of the marking material leveler 122. The controller 150 can determine an adjusted amount of release fluid to spray to the marking material leveling system 120 based on substrate throughput carryout of release fluid by the substrate 112 from the marking material leveling system 120.

A pressure and on/off solenoid valve 136 can be used to control application rates. The solenoid valve 136 can change the rate and duration of pulses of release fluid 132. The release fluid can be provided at a pressure of 20-50 psi, 10-100 psi, or more. The frequency, duration, pressure, duty cycle, and other variables of the pulse sprayed release fluid can be adjusted. For example, the variables can be adjusted during ramp up and ramp down, such as when changing from apparatus standby to steady state and back. The variables can also be adjusted between substrate sheets 112. As a further example, the variables can be adjusted based on the substrate type. For example, whether the substrate is rough paper or plastic. If rough paper the duty cycle can be higher if plastic the duty cycle can be less regardless of speed. Also, the throughput speed may be adjusted or both throughput speed and other variables may be adjusted. As an estimate, the duty cycle can be between 0.01 cycles per second and 1000 cycles per second. Separate fluid lines or a common fluid rail can be used to provide fluid to each of a plurality of spray nozzles of the at least one spray nozzle 130. Pulsing of each of the plurality of spray nozzles may be synchronized or may not be synchronized. Also, the spray nozzles may or may not spray the leveler at different times or at the same time, which can result in different parts or the same part of the leveler being sprayed.

The release fluid can be water with additives that are added to assist releasing the substrate 112 from the marking material leveler 122. The marking material leveling system 120 can level marking material 114 on the substrate 112 using the marking material leveler 122 with release fluid to produce leveled marking material 116 on the substrate 112.

Figure 2:
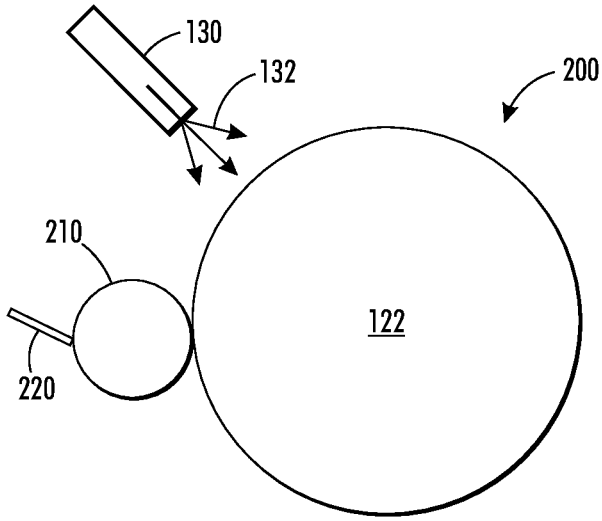
FIG. 2 is an example illustration of an apparatus according to one possible embodiment.

FIG. 2 is an example illustration of an apparatus 200 according to one embodiment. The apparatus 200 can include elements of the apparatus 100, such as the marking material leveler 122, the at least one release fluid spray nozzle 130, and other elements of the apparatus 100. The at least one release fluid spray nozzle 130 can spray release fluid 132 directly onto the marking material leveler 122. For example, the marking material leveler 122 can be a marking material leveling roll and the release fluid 132 can be sprayed directly onto the marking material leveling roll using the at least one release fluid spray nozzle 130. The apparatus 200 can also include a metering roll 210 coupled to the marking material leveler 122. The metering roll 210 can meter release fluid on the marking material leveler 122. For example, the metering roll 210 can contact the marking material leveling roll 122 and adjust, reduce, split, make the layer more uniform in the process and cross process directions, or otherwise meter release fluid on the marking material leveling roll 122. The apparatus 200 can include a blade 220 that can remove release fluid from the metering roll 210.

Figure 3:
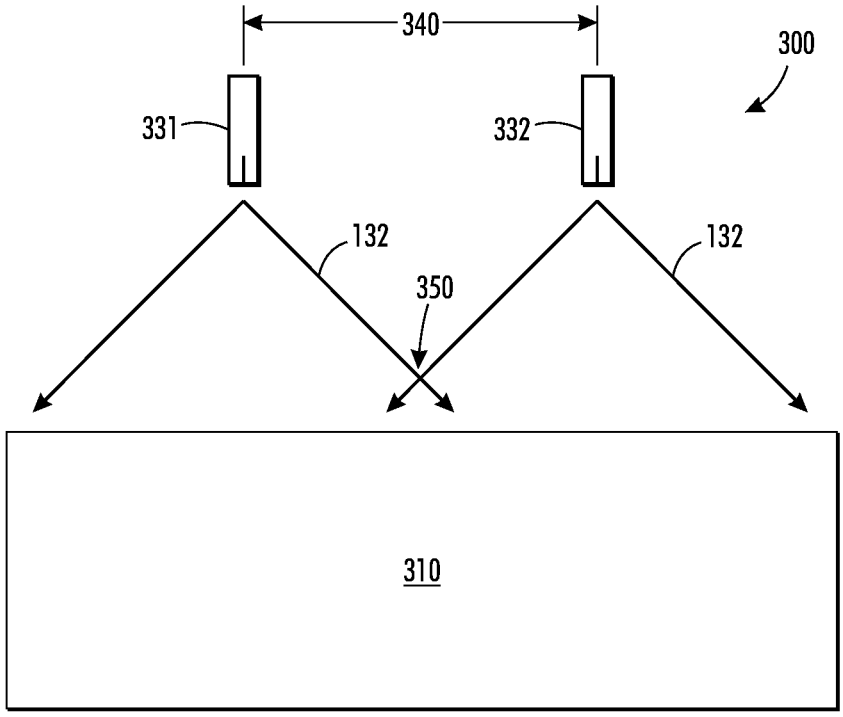
FIG. 3 is an example illustration of an apparatus according to one possible embodiment.

FIG. 3 is an example illustration of an apparatus 300 according to one embodiment. The apparatus 300 can include elements of the apparatus 100 and/or the apparatus 200. The apparatus 300 can include a marking material leveler 310, such as the marking material leveler 122. The apparatus 300 can further include a first spray nozzle 331 and a second spray nozzle 332, such as the spray nozzle 130. The apparatus 300 can also include additional spray nozzles. The spray nozzles 331 and 332 can spray release fluid 132 for the marking material leveler 310. The spray nozzles 331 and 332 can spray the release fluid 132 directly onto the marking material leveler 310 or can spray the release fluid 132 onto an intermediate element, such as a donor roll (not shown) and the release fluid 132 can be transferred to the marking material leveler 310.

The spray nozzles 331 and 332 can be spaced a distance from each other 340 depending on the desired spray from the spray nozzles 331 and 332. The sprayed release fluid 132 can overlap 350. Common electronics or different electronics can be used for each spray nozzle 331 and 332. The electronics can sense when one nozzle has degraded performance or is otherwise not functioning correctly using sensors or other feedback mechanisms coupled to the nozzle, and can adjust accordingly and/or set a flag.

Embodiments can provide for applying a thin layer of release fluid 132, such as fountain solution that can include water and additives, to a leveler roll surface, such as the marking material leveler 122 surface 134.

According to one example, a thin, such as about 300 nm, release fluid layer can be specifically formulated to promote release of the ink-image 116 and substrate 112 from the roller 122 following a leveling nip. If fountain solution, such as release fluid, is not used, the ink 114 can stick to the roll surface 134 and either the ink layer 116 can split causing offset or the entire sheet 112 can adhere to the roll 122 causing a jam and potential service call.

Embodiments can use ultra low volume wide-flat spray nozzles that have been specifically designed and manufactured to apply a uniform spray pattern when properly spaced and pressurized. For example, two nozzles, when properly spaced from the donor roll and from each other, can administer a very uniform amount of fluid along the rotational axis of the donor roll 140. A soft-nip forming donor roll can absorb the fluid and can split the fluid to the leveler roll 122. This concept was tested and was able to successfully release partially cured and contact leveled prints on substrates 112.

Embodiments can provide for a method by which to modify the application rate of a fountain solution that is used as a release fluid depending on the media being run. For example, one issue with applying ultraviolet curable ink digitally via a print head is that the surface of solid areas is not uniform. "Spaghetti" lines form in the solid and make visually objectionable gloss differentials. Embodiments can use ultraviolet curable gel inks in combination with contact leveling to minimize this effect. The contact leveling technologies can require release fluid. Since all prior digital ink jet ultraviolet printers experience the corduroy effect from lines being laid down by adjacent jets, embodiments using gel ink and contact leveling technologies that include release fluid delivery can offer a solution to the problem. Additionally, embodiments can do this without the need for overcoats which can make the process cheaper.

As a further example, in the case of contact leveling with ultraviolet gel ink technology, fountain solutions can be used as a release layer when the leveling roll is a hydrophilic surface. One issue however can be that the media being printed on may or may not have an impact on the fountain solution carry-out rate. That is, rough porous media can soak up more fountain solution than a plastic media, which will absorb none. As a result, some media will cause the leveling roll to be drier than others which can lead to inconsistent release performance. Embodiments can provide a spray system that, when coupled to a pulse width modulation operation, can modify the amount of fluid delivered to the leveling roll according to a programmed algorithm for consistent release performance.

Continuing with another example, contact leveling can be integrated into a ultraviolet gel ink printing system. The contact leveler can include essentially a pair of rollers, much like a fuser roll/pressure roll configuration, which can spread the ink prior to final ultraviolet cure. Much like a fuser, the leveling roll uses surface characteristics that inhibit the ink sticking or offsetting to the roll. The application of a thin layer of fountain solution, such as water with additives, to the leveler roll surface can reduce ink offsetting. Embodiments can apply the fluid using a fine controlled spray nozzle combined with an intermediate donor roll. Embodiments can provide an algorithm that changes the amount of fluid being applied to the donor roll by adjusting the spray nozzle pulse width modulation according to the user input of the media type being run, such as porous vs. non porous media.

Embodiments can use of a low volume spray nozzle to accurately apply fountain solution to an intermediate donor roller which can in turn apply a uniform layer onto the contact leveling roll surface. The donor roll can be comprised of an elastomer with a fabric or similar porous coating. The reason for this is that the spray can be pulsed and as such a device can be used to make sure the fluid is uniformly distributed about the donor roll. A layer that has capillary action can accomplish this task.

The thin (~300 nm) fluid layer can be formulated to promote release of the ink-image and substrate from the roller following a leveling nip. If fountain solution is not used, the ink will stick to the roll surface and either split within the ink layer causing offset or the entire sheet will adhere to the roll causing a jam and potential service call. Embodiments can provide solutions to this and other problems.

Ultra low volume wide-flat spray nozzles can apply a uniform spray pattern when properly spaced and pressurized. For example, two nozzles properly spaced from the donor roll and from each other can administer a very uniform amount of fluid along the axis of a donor roll and the level of fluid delivered can be consistent for a given media.

A spray nozzle can pulse the nozzle and effectively change the delivery rate as a function of conditions. Since different media types have a different affinity for soaking up water based solutions, i.e. porous media readily accepts water and plastics accept no water, the amount of fluid that can be applied to the leveling roll to maintain uniform release performance can vary. A pulsed spray nozzle can maintain uniform release performance.

According to some embodiments, a component, such as a moisture sensor, can measure the moisture on the media after the nip. For example, a Near Infrared (NIR) moisture analyzer can measure surface moisture of many products. In the case of changing the amount of fluid delivered as a function of the start of run or image content, or even media type, the addition of the moisture meter can allow for a closed loop control whereby the pulse width parameters can be changed in order to increase or decrease the fluid rate as needed and as measured by the meter.

Embodiments can also change the frequency at which the spray nozzles are pulsed to match the printing speed 170 when the speeds the printer is printing at change, for example between photo quality vs. standard quality modes. The fluid delivery rate can be adjusted so that the fluid layer is uniform and leveling performance is not impacted by the speed change. The fluid delivery rate can also be adjusted to account for changing evaporation rates of the fluid from the roll surface to account for relative humidity of the environment. The fluid delivery rate can further be adjusted to account for image content and the location in time of a printing apparatus during run state. As an example of the run state, the start of a print job may have more fluid on a leveler than mid run of the job, and the fluid delivery rate can be adjusted accordingly during the print job.

Figure 4:
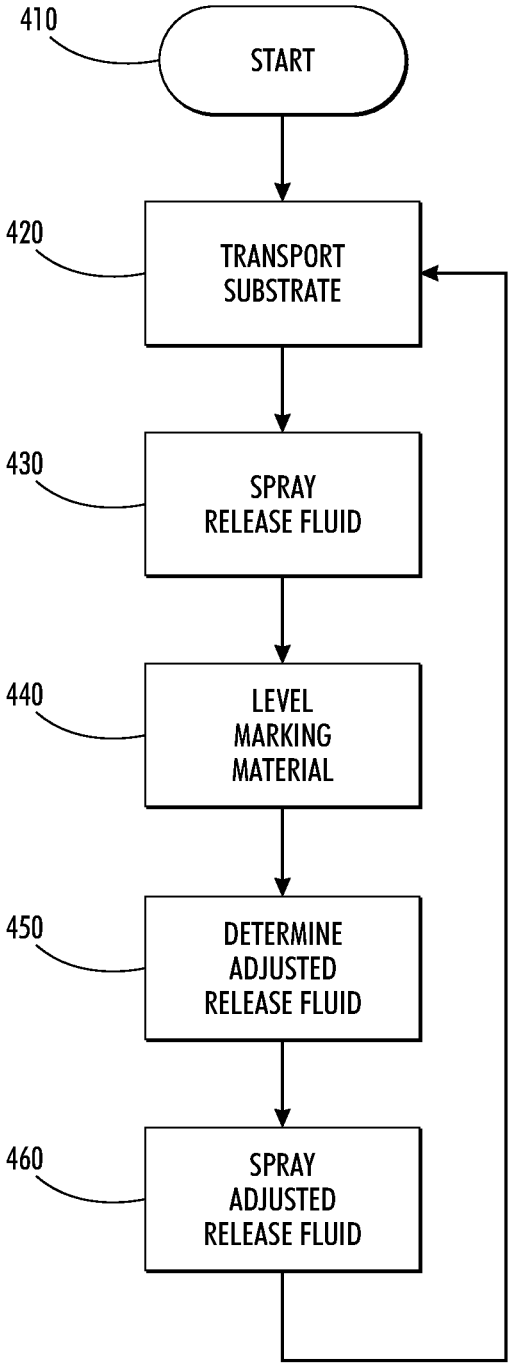
FIG. 4 illustrates an example flowchart of a method of applying release fluid to a leveler in a printing apparatus according to one possible embodiment.

FIG. 4 illustrates an example flowchart 400 of a method of applying release fluid to a leveler in a printing apparatus, such as the printing apparatus 100, according to one possible embodiment. The apparatus can have a substrate path, at least one release fluid spray nozzle, and a marking material leveling system having a marking material leveler. The marking material leveling system can include a donor roll. The spray nozzle can be configured to spray release fluid with a viscosity of less than 10 centipoise. For example, the spray nozzle can be specially designed to spray release fluid with a viscosity of less than 10 centipoise.

The method can start at 410. At 420, a substrate with marking material can be transported along the substrate path. The marking material can be an radiation curable ink.

At 430, release fluid can be pulse sprayed to the marking material leveling system using the at least one release fluid spray nozzle. Pulse spraying can include pulse spraying release fluid onto the donor roll using the at least one release fluid spray nozzle and the release fluid can be transferred from the donor roll to the marking material leveler. Pulse spraying can also include pulse spraying release fluid directly onto the marking material leveler using the at least one release fluid spray nozzle. At 440, marking material can be leveled on the substrate using the marking material leveler with release fluid.

At 450, an adjusted amount of release fluid to spray to the marking material leveling system can be determined. Determining can include determining an adjusted amount of release fluid to spray to the marking material leveling system based on the media type of the substrate, where an entry of the media type can be received at a user input. For example, different substrate media types can carry out different amounts of release fluid from the marking material leveler after the substrate leaves the marking material leveler. This can be based on the different absorption abilities of different media types. A user can input or the apparatus can detect the media type of the substrate being run through the apparatus. A controller of the apparatus can then determine an adjusted amount of release fluid based on the media type to account for different carry out abilities of different media types. For example, the controller can use an algorithm or look up carryout data in a lookup table to determine different carry out abilities of different media types.

Determining can also include determining an adjusted amount of release fluid to spray to the marking material leveling system based on moisture measured on the substrate after the substrate leaves the marking material leveler. For example, moisture on the substrate can be measured using a sensor, such as a moisture meter. The apparatus can then determine an adjusted amount of release fluid in a closed loop manner or can run open loop to account for the accuracy of the moisture meter. For example, the apparatus can determine an adjusted amount of release fluid in an open loop manner by receiving additional inputs if the moisture meter is inaccurate. Determining can additionally include determining an adjusted amount of release fluid to spray to the marking material leveling system based on throughput speed of the substrate through the marking material leveling system. The adjusted amount of release fluid can be determined to provide a uniform release fluid layer on the marking material leveler. Determining can also include determining an adjusted amount of release fluid to spray to the marking material leveling system based on substrate throughput carryout of release fluid by the substrate.

At 460, the adjusted amount of release fluid can be pulse sprayed to the marking material leveling system using the at least one release fluid spray nozzle. For example, pulsing can be a series of intermittent occurrences including changes in quantity of release fluid. The amount of release fluid can be adjusted by adjusting pulse width modulation of release fluid from the spray nozzle, by adjusting frequency of spray of release fluid from the spray nozzle, by adjusting pressure of release fluid from the spray nozzle, and/or by other relevant adjustments.

According to some embodiments, all of the blocks of the flowchart 400 are not always necessary. Additionally, the flowchart 400 or blocks of the flowchart 400 may be performed numerous times, such as iteratively. For example, the flowchart 400 may loop back from later blocks to earlier blocks. Furthermore, many of the blocks can be performed concurrently or in parallel processes.

Figure 5:
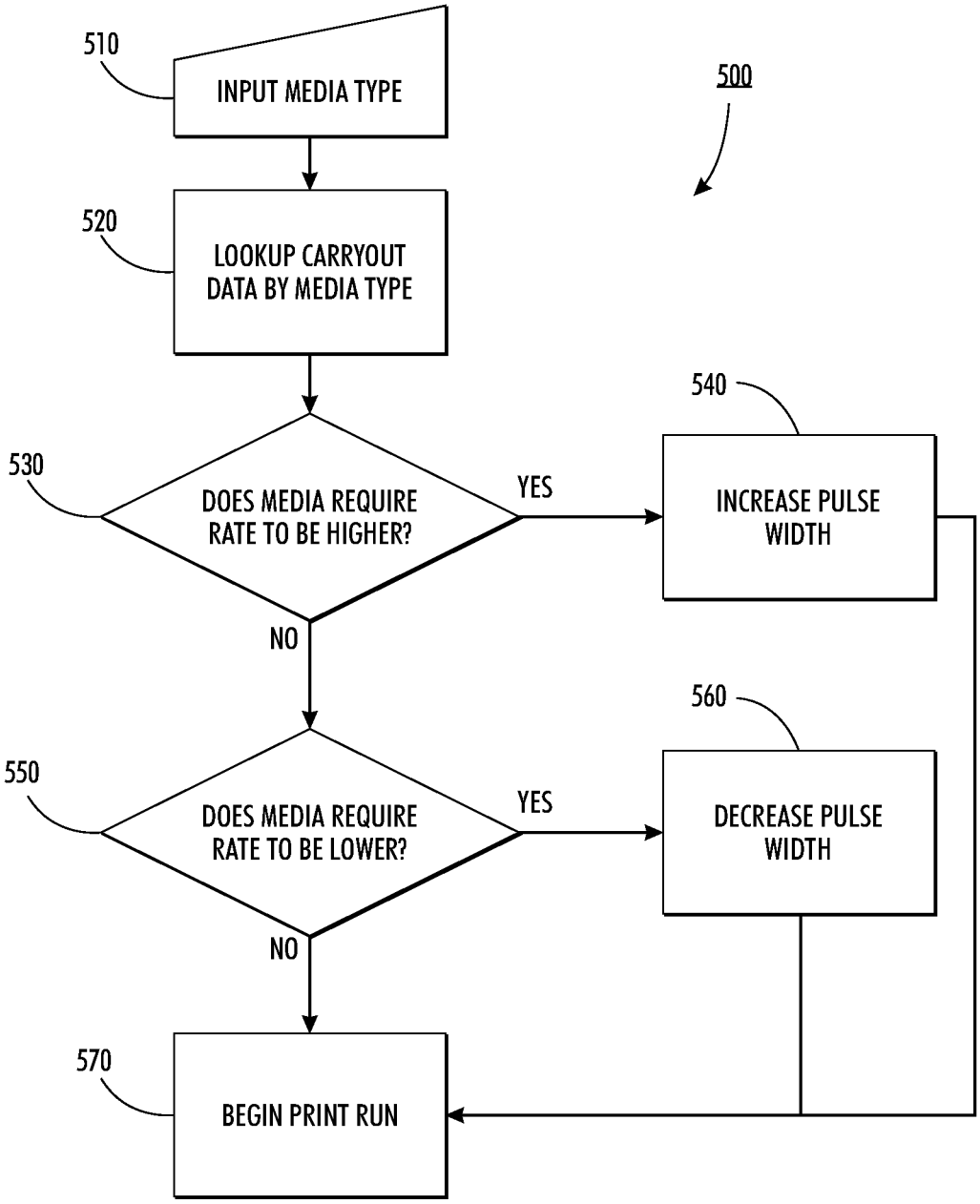
FIG. 5 illustrates an example flowchart of a method of applying release fluid to a leveler in a printing apparatus according to one possible embodiment.

FIG. 5 illustrates an example flowchart 500 of a method of applying release fluid to a leveler in a printing apparatus, such as the printing apparatus 100, according to one possible embodiment. At 510, a media type can be input into the printing apparatus. At 520, carryout data can be looked up in a lookup table according to media type. At 530, whether the media type requires a higher rate of release fluid application can be determined. If the media type requires more release fluid, at 540, the pulse width of release fluid application can be increased. At 550, whether the media type requires a lower rate of release fluid application can be determined. If the media type requires less release fluid, at 560, the pulse width of release fluid application can be decreased. At 570, a print run can begin.

According to some embodiments, the blocks of the flowchart 500 can be combined with the flowchart 400. Also, all of the blocks of the flowchart 500 are not always necessary. Additionally, the flowchart 500 or blocks of the flowchart 500 may be performed numerous times, such as iteratively. For example, the flowchart 500 may loop back from later blocks to earlier blocks. Furthermore, many of the blocks can be performed concurrently or in parallel processes.

Figure 6:
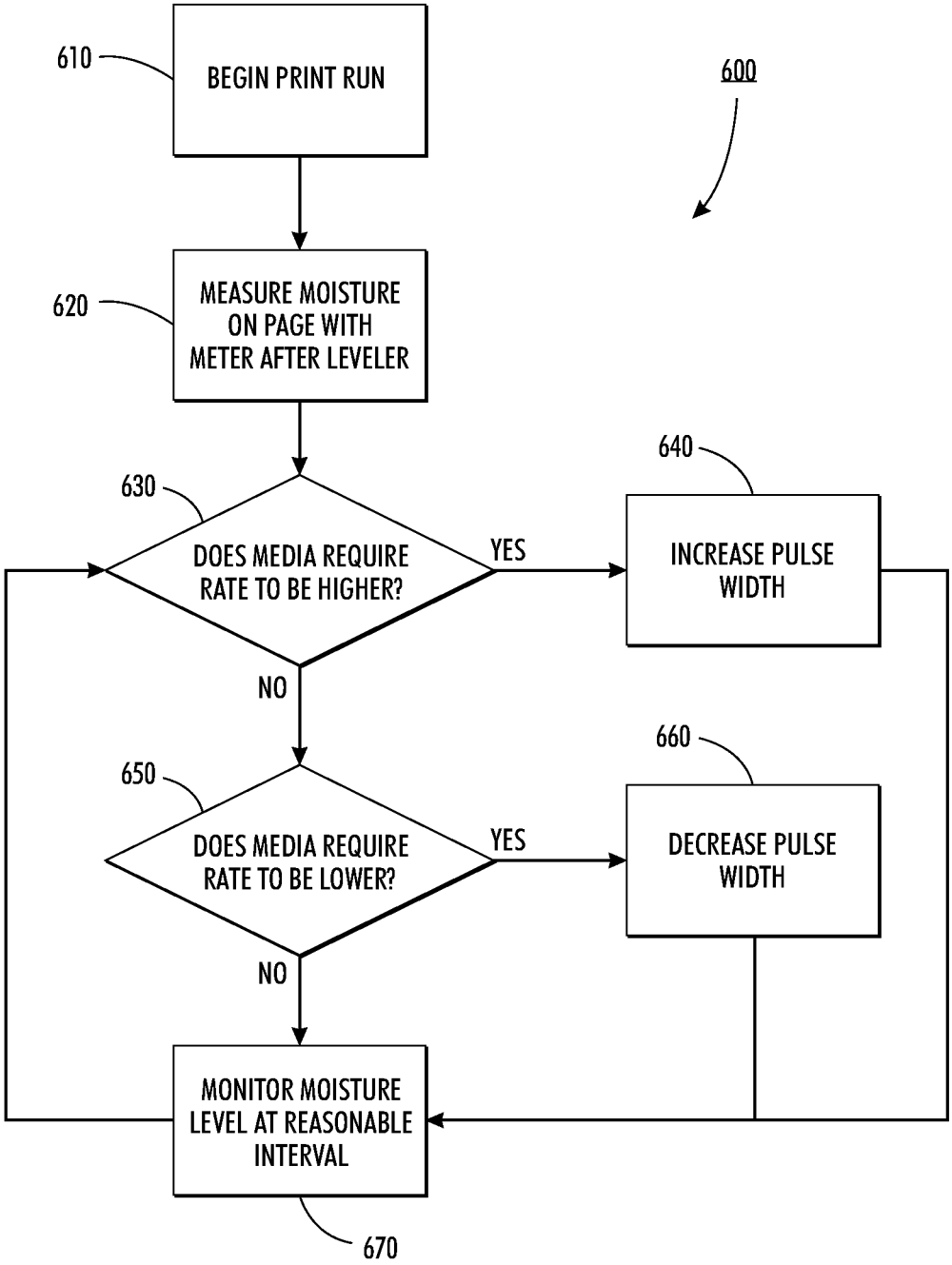
FIG. 6 illustrates an example flowchart of a method of applying release fluid to a leveler in a printing apparatus according to one possible embodiment.

FIG. 6 illustrates an example flowchart 600 of a method of applying release fluid to a leveler in a printing apparatus, such as the printing apparatus 100, according to one possible embodiment. At 610, a print run can begin. At 620, moisture on a page can be measured after leveling. Other methods can be used to monitor moisture levels, such as by monitoring a moisture level on a marking material leveler after leveling or by other methods of monitoring moisture levels. At 630, whether the media type requires a higher rate of release fluid application can be determined. If the media type requires more release fluid, at 640, the pulse width of release fluid application can be increased. At 650, whether the media type requires a lower rate of release fluid application can be determined. If the media type requires more release fluid, at 660, the pulse width of release fluid application can be decreased. At 670, the moisture level can be monitored at a reasonable, regular, and/or periodic interval for further adjustments. In the methods, the amount of release fluid can be modified by other ways than just increasing or decreasing the pulse width of release fluid application. For example, a duty cycle of release fluid application can be adjusted, an amplitude of release fluid application can be adjusted, a frequency of release fluid application can be adjusted, the number of nozzles applying release fluid can be adjusted, and other adjustments can be made that affect an amount of release fluid applied to a marking material leveler.

According to some embodiments, the blocks of the flowchart 600 can be combined with the flowcharts 400 and/or 500. Also, all of the blocks of the flowchart 600 are not always necessary. Additionally, the flowchart 600 or blocks of the flowchart 600 may be performed numerous times, such as iteratively. For example, the flowchart 600 may loop back from later blocks to earlier blocks. Furthermore, many of the blocks can be performed concurrently or in parallel processes.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method in an apparatus including a substrate path, at least one release fluid spray nozzle, and a marking material leveling system having a marking material leveler, the method comprising:

transporting a substrate with marking material along the substrate path;

pulse spraying release fluid to the marking material leveling system using the at least one release fluid spray nozzle;

leveling marking material on the substrate using the marking material leveler with release fluid;

determining an adjusted amount of release fluid to spray to the marking material leveling system; and pulse spraying the adjusted amount of release fluid to the marking material leveling system using the at least one release fluid spray nozzle.

2. The method according to claim 1, wherein the marking material leveling system includes a donor roll, wherein pulse spraying comprises pulse spraying release fluid onto the donor roll using the at least one release fluid spray nozzle, and wherein the method further comprises transferring the release fluid from the donor roll to the marking material leveler.

3. The method according to claim 1, wherein pulse spraying comprises pulse spraying release fluid directly onto the marking material leveler using the at least one release fluid spray nozzle.

4. The method according to claim 1, further comprising receiving a user input of a media type of the substrate, wherein determining comprises determining an adjusted amount of release fluid to spray to the marking material leveling system based on the media type of the substrate.

5. The method according to claim 1, further comprising measuring moisture on the substrate after the substrate leaves the marking material leveler, wherein determining comprises determining an adjusted amount of release fluid to spray to the marking material leveling system based on the measured moisture on the substrate.

6. The method according to claim 1, wherein the amount of release fluid is adjusted by one of adjusting pulse width modulation of release fluid from the spray nozzle, adjusting frequency of spray of release fluid from the spray nozzle, and adjusting pressure of release fluid from the spray nozzle.

7. The method according to claim 1, wherein determining comprises determining an adjusted amount of release fluid to spray to the marking material leveling system based on throughput speed of the substrate through the marking material leveling system.

8. The method according to claim 1, wherein adjusted amount of release fluid is determined to provide a uniform release fluid layer on the marking material leveler.

9. The method according to claim 1, wherein determining comprises determining an adjusted amount of release fluid to spray to the marking material leveling system based on substrate throughput carryout of release fluid by the substrate.

10. The method according to claim 1, wherein the marking material comprises radiation curable ink.

11. An apparatus comprising:

a substrate path that transports a substrate with marking material;

a marking material leveling system having a marking material leveler;

at least one release fluid spray nozzle that pulse sprays release fluid to the marking material leveling system, where the marking material leveler with the release fluid levels marking material on the substrate; and a controller that determines an adjusted amount of release fluid to spray to the marking material leveling system, wherein the at least one release fluid spray nozzle pulse sprays the adjusted amount of release fluid to the marking material leveling system.

12. The apparatus according to claim 11, wherein the marking material leveling system comprises a donor roll, wherein the at least one release fluid spray nozzle pulse sprays release fluid onto the donor roll, and wherein the donor roll transfers the release fluid from the at least one release fluid spray nozzle to the marking material leveler.

13. The apparatus according to claim 11, wherein the at least one release fluid spray nozzle pulse sprays release fluid directly onto the marking material leveler.

14. The apparatus according to claim 11, further comprising a user interface configured to receive a user input of a media type of the substrate, wherein the controller determines an adjusted amount of release fluid to spray to the marking material leveling system based on the media type of the substrate.

15. The apparatus according to claim 11, further comprising a moisture sensor that measures moisture on the substrate after the substrate leaves the marking material leveler, wherein the controller determines an adjusted amount of release fluid to spray to the marking material leveling system based on the measured moisture on the substrate.

16. The apparatus according to claim 11, wherein the controller determines an adjusted amount of release fluid to spray to the marking material leveling system based on throughput speed of the substrate through the marking material leveling system.

17. The apparatus according to claim 11, wherein the controller determines the adjusted amount of release fluid to provide a uniform release fluid layer on the marking material leveler.

18. The apparatus according to claim 11, wherein the controller determines an adjusted amount of release fluid to spray to the marking material leveling system based on substrate throughput carryout of release fluid by the substrate.

19. A method in an apparatus including a substrate path, at least one release fluid spray nozzle, and a marking material leveling system having a marking material leveler, the method comprising:

transporting a substrate with marking material along the substrate path;

pulse width modulation spraying release fluid to the marking material leveling system using the at least one release fluid spray nozzle;

leveling marking material on the substrate using the marking material leveler with release fluid;

determining an adjusted amount of release fluid to spray to the marking material leveling system; and pulse width modulation spraying the adjusted amount of release fluid to the marking material leveling system using the at least one release fluid spray nozzle.

20. The method according to claim 19, wherein the amount of release fluid is adjusted by adjusting one of a pulse width, a frequency, a pressure, and a duty cycle of release fluid from the spray nozzle based on one of a startup vs. steady state condition of a print run and a marking material image content on the substrate.

* * * * *